United States Patent [19]

Blodgett et al.

[11] Patent Number: 4,505,544

[45] Date of Patent: Mar. 19, 1985

[54] SPATIAL FREQUENCY MULTIPLEXED COHERENT OPTICAL PROCESSOR FOR CALCULATING GENERALIZED MOMENTS

[75] Inventors: Jerry A. Blodgett, Annandale, Va.; Harold H. Szu, Bethesda, Md.; C. Lee Giles, Potsdam, N.Y.; Ravindra Athale, Annandale, Va.

[73] Assignee: The United States of America as represented by the Secretary of the Navy, Washington, D.C.

[21] Appl. No.: 387,133

[22] Filed: Jun. 10, 1982

[51] Int. Cl.[3] ..... G06G 9/00

[52] U.S. Cl. ..... 350/162.13; 364/822; 350/162.15

[58] Field of Search ..... 350/162.11, 162.12, 350/162.13, 162.15; 364/822; 343/9 PS

[56] References Cited

U.S. PATENT DOCUMENTS 3,776,616 12/1983 Donklias ..... 350/162.15
4,037,965 7/1973 Weiss ..... 350/162.12

OTHER PUBLICATIONS

Casasent et al., "Hybrid Processor to Compute Invariant Moments for Pattern Recognition", *Optics Letters*, vol. 5, No. 9, Sep. 1980, pp. 395 to 397.

L. J. Cutrona et al., "Optical Data Processing and Filtering Systems", IRE Transactions on Information Theory (Jun. 1960), pp. 386–400.

*Primary Examiner*—Bruce Y. Arnold
*Assistant Examiner*—William Propp
*Attorney, Agent, or Firm*—Robert F. Beers; William T. Ellis; Alan P. Klein

[57] ABSTRACT

An optical processor that can compute the moments of a two-dimensional image in parallel. The image is placed at the plane of a holographic mask which is disposed in the front focal plane of a Fourier-transforming lens and each of the desired moments is found at a respective one of a plurality of photodetectors arrayed in the back focal plane of the lens.

9 Claims, 4 Drawing Figures

SPATIAL FREQUENCY MULTIPLEXED COHERENT OPTICAL PROCESSOR FOR CALCULATING GENERALIZED MOMENTS

BACKGROUND OF THE INVENTION

This invention relates generally to optical pattern recognition, and more particularly to the computation of image moments for object identification.

Image moments have been used for some time in the field of pattern recognition. In a visual image, let f(x,y) be a measure of brightness at the point (x,y). The geometric moments of the image are defined by $$\mu_{mn} = \int_{-\infty}^{\infty} \int_{-\infty}^{\infty} f(x,y)x^m y^n dxdy$$

where $x^m y^n$ is the generating function of the geometric moments, m, n=0, 1, 2, . . . and integration is over the entire visual image. Brightness can be regarded as analogous to mass. $\mu_{00}$ is the total brightness or mass of the image, $\mu_{20}$ and $\mu_{02}$ can be thought of as moments of inertia of the image about the y and x axes, and so forth. Given an input image, one can evaluate a chosen set of its moments.

An advantage of applying pattern recognition techniques to these moments rather than directly to the image is that the number of the moments required to recognize the object may be less than the total number of elements in the image.

In applying pattern recognition techniques to image moments, a small number of moments are computed for an isolated object and these moments or combinations thereof are used to determine the object from a small library of objects of interest and their appropriate moments. These calculations are normally done on a digital computer as described, for example, in the article "Aircraft Identification by Moment Invariants", by S. A. Dudani et al. IEEE Transaction on Computers, Vol. C-26, No. 1 (1977) pp. 39–45.

Digital techniques for computing image moments are as accurate as the data input and the simple moments can be calculated for imagery being acquired at the rate of 30 frames per second or possibly greater. The digital equipment required, however, is complex, bulky and expensive. In addition, complex moments may not be calculable in real time. Optical techniques for calculating the simple moments have been proposed but are complicated in the case of the proposal of M. R. Teague in "Optical Calculations of Irradiance Moments", Applied Optics 19, pp. 1353–1356 (1980), or limited to simple geometric moments in the proposal of D. Casasent and D. Psaltis in "Hybrid Processor to Compute Invariant Moments for Pattern Recognition", Optics Letters 5, pp. 395–397 (1980). An earlier proposal by the latter authors in "Optical Pattern Recognition Using Normalized Invariant Moments", Proceedings of the Soc. of Photo-Optical Instrumentation Engineers, Vol. 201, pp. 107–114 (1979) had additional limitations in that it computed only one moment at a time and the moments had a bias which had to be considered and which further limited the dynamic range.

SUMMARY OF THE INVENTION

Accordingly, it is an object of the present invention to compute the moments of an isolated object in a manner which is faster and simpler then existing techniques.

It is another object to compute the moments for any generating function of the form $g_{mn}(x,y)$, which may prove useful in more difficult pattern recognition problems.

These and other objects of the present invention are achieved by an optical processor which computes a plurality of moments of a two-dimensional image in parallel. The optical processor includes a Fourier transforming lens; a holographic mask disposed in the front focal plane of the lens and having a transmittance proportional to the sum of the generating functions of each of the desired moments respectively multiplied by a corresponding spatial carrier; and a two-dimensional array of photodetectors disposed in the back focal plane of the lens. The individual photodetectors are so spatially separated that when the image is placed at the plane of the holographic mask, the lens forms in its back focal plane the Fourier transform of the intensity function of the image times the transmittance of the mask, and each of the desired moments is found at a respective one of the photodetectors. The generating functions can be those of the geometric moments or of more complicated moments.

The advantages of this method of moment generation over digital computer techniques are size, cost, and speed. The advantage over the optical method proposed by Teague is simplicity and, perhaps, stability. The advantages over the method proposed by Casasent and Psaltis is the absence of any weighting factor, m! n!, in the denominator of the moments and the ability to generate moments using other basis functions.

The use of functions other then $x^m y_n$ for moments offers significant advantages. For a given class of objects, one set of basis functions may be considerably more efficient in describing and differentiating the members of that class. In addition, the ability to compute combinations of moments optically and to scale the moments so as to minimize the dynamic range allows the optical system to perform in an optimum manner.

Additional advantages and features will become apparent as the subject invention becomes better understood by reference to the following detailed description when considered in conjunction with the accompanying drawings wherein:

DESCRIPTION OF THE PREFERRED EMBODIMENT

Figure 1:
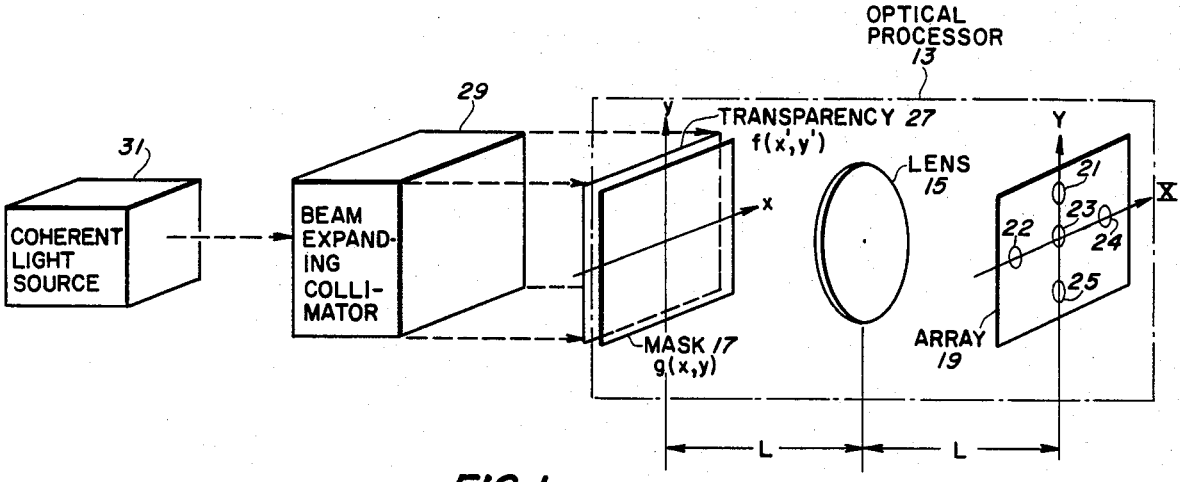
FIG. 1 is a block diagram of an embodiment of the invention.

FIG. 1 shows an optical processor (outlined by the chain line 13) for computing a plurality of moments of a two-dimensional image in parallel. The image is characterized by an intensity function f(x',y') which is a measure of brightness at the point (x',y') in the image plane.

The optical processor 13 includes a Fourier-transforming lens 15 such as, for example, a Space Optics Research Lab Model FX-23; a holographic mask 17 disposed in the front focal plane of the lens 15; and a two-dimensional array 19 of photodetectors 21–25, such as, for example, an EG & G Reticon Model RA 100×100, disposed in the back focal plane of the lens 15. The holographic mask 17 is characterized by a transmittance which is proportional to the sum of the generating functions of each of the desired moments respectively multiplied by a corresponding spatial carrier. Specifically, the transmittance is of the form $$g(x,y) = A \sum_{m=-M}^{M} \sum_{n=-N}^{N} g_{mn}(x,y) e^{j(mu_o x + nv_o y)}$$

In the formula, x and y are the two variables defining the mask plane, A is a proportionality constant, $g_{mn}(x,y)$ is the generating function of $mn^{th}$ moment (there being 2M×2N such moments); $e^{j(mu_o x + nv_o y)}$ is the spatial carrier and the notation $e^{j(mu_o x + nv_o y)}$ designates that the constant e is raised to the $j(mu_o x + nv_o y)$ power where $j = \sqrt{-1}$ and $u_o$ and $v_o$ are arbitrary scaling factors. The generating function $g_{mn}(x,y)$ can be the bipolar one required for the geometric moments, $x^m y^n$, or can be a more complicated function, such as, for example, a Legendre Polynominal or an angular prolate spheriodal function. The function $g_{mn}(x,y)$ can also be complex or a moment invariant, or both. The term "moment invariant" as used in the specification means a moment or a combination of moments whose value does not change when some property of the image, such as size or rotation angle, changes. The generation of the holographic mask 17 is within the skill of the art. Any of several well-known techniques which have been developed in making digital holograms can be used. As evidence of the level of skill in the art, see, for example, "Computer-Generated Holograms: Techniques and Applications", by W. H. Lee, in *Progress in Optics,* Vol. XVI, ed. Emil Wolf, North Holland Pub. Co. (1978) and "Spatial Filtering by Digital Holography" by K. Campbell et al., in *Optical Engineering,* Vol. 13, No. 3, p. 175 (1974), whose disclosures are incorporated herein by reference. Basically, the complex information is encoded on a spatial frequency carrier and only a transparency varying in amplitude transmission is required. This allows any function to be generated and permits some pre-weighting of the moments to compensate for possibly excessive dynamic range.

The individual photodetectors 21–25 are spatially separated so that when the image of an object to be identified is placed at the plane of the holographic mask 17, the lens 15 forms in its back focal plane the Fourier transform of the intensity function of the image times the transmittance of the mask 17 and each of the desired moments is found at a respective one of the photodetectors 21–25. More specifically, the individual photodetectors are located at positions $$X = \frac{L}{\kappa}(mu_o),\ Y = \frac{L}{\kappa}(nv_o)$$

in the back focal plane of the lens 15, where m=−M, . . . ,M and n=−N, . . . ,N. In the formulas, X and Y are the two variables defining the back focal plane, L is the focal length of the lens 15, and k is the wave number of the light forming the image. When the image is placed at the plane of the holographic mask 17, the light distribution appearing at the array 19 of photodetectors is of the form $$U(X,Y) = \int_{-\infty}^{\infty} \int_{-\infty}^{\infty} f(x,y) g(x,y) e^{-jk(Xx+Yy)/L} dx dy$$

or more specifically of the form $$U(X,Y) = \sum_{m=-M}^{M} \sum_{n=-N}^{N} \int_{-\infty}^{\infty} \int_{-\infty}^{\infty} f(x,y) g_{mn}(x,y) e^{-j[(\frac{kX}{L} - mu_o)X + (\frac{kY}{L} - nv_o)y]} dx dy$$

and each of the desired moments $$\mu_{mn} = \int_{-\infty}^{\infty} \int_{-\infty}^{\infty} f(x,y) g_{mn}(x,y) dx dy$$

where m=−M, . . . , M and n=−N, . . . , N is found at a respective one of the locations of the individual photodetectors 21–25 (as may be seen by substituting $X=(L/R)(mu_o)$, $Y=(L/R)(nv_o)$ into U(X,Y)). While the step of placing the image at the plane of the holographic mask 17 may take a variety of forms, conveniently it may take the form shown in FIG. 1 of laying the holographic mask 17 on a transparency 27 or other spatial light modulator whose transmittance is proportional to the intensity function f(x′,y′) of the image of the object, and illuminating the transparency with a parallel beam of coherent light. The parallel beam of coherent light may be produced by a beam-expanding collimator 29, such as, for example, a Newport Research Corp. Model LC-V, operating on the light emitted by a coherent light source 31, such as a laser.

For a clearer understanding of the invention, a specific example of it is set forth below. This example is merely illustrative and is not to be understood as limiting the scope and underlying principles of this invention in ay way.

EXAMPLE

Figure 2:
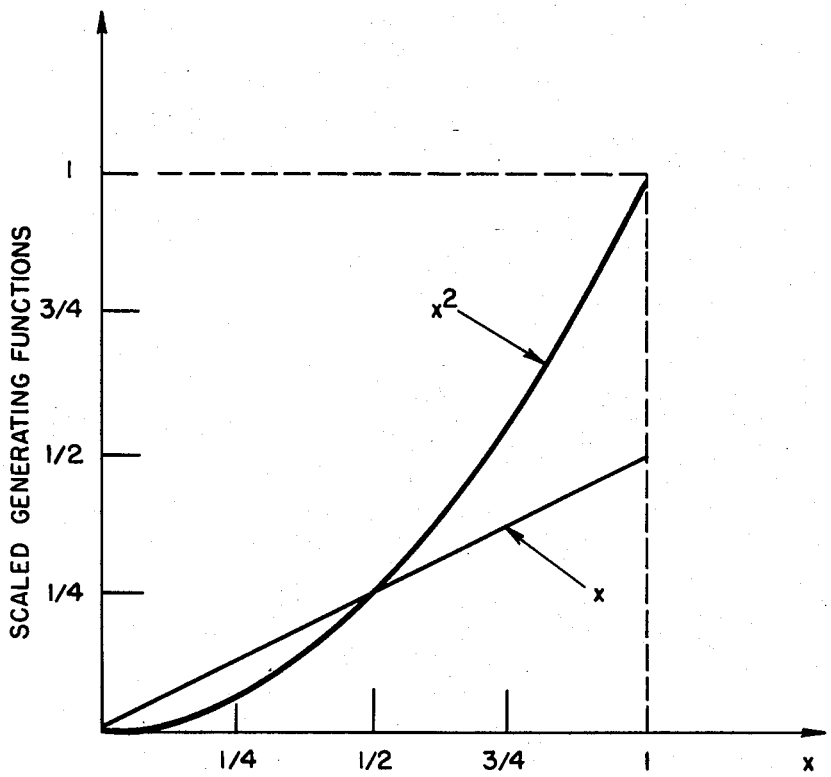
FIG. 2 is a plot of the generating functions x and $x^2$ with x multiplied by a weight of $\frac{1}{2}$.
Figure 3:
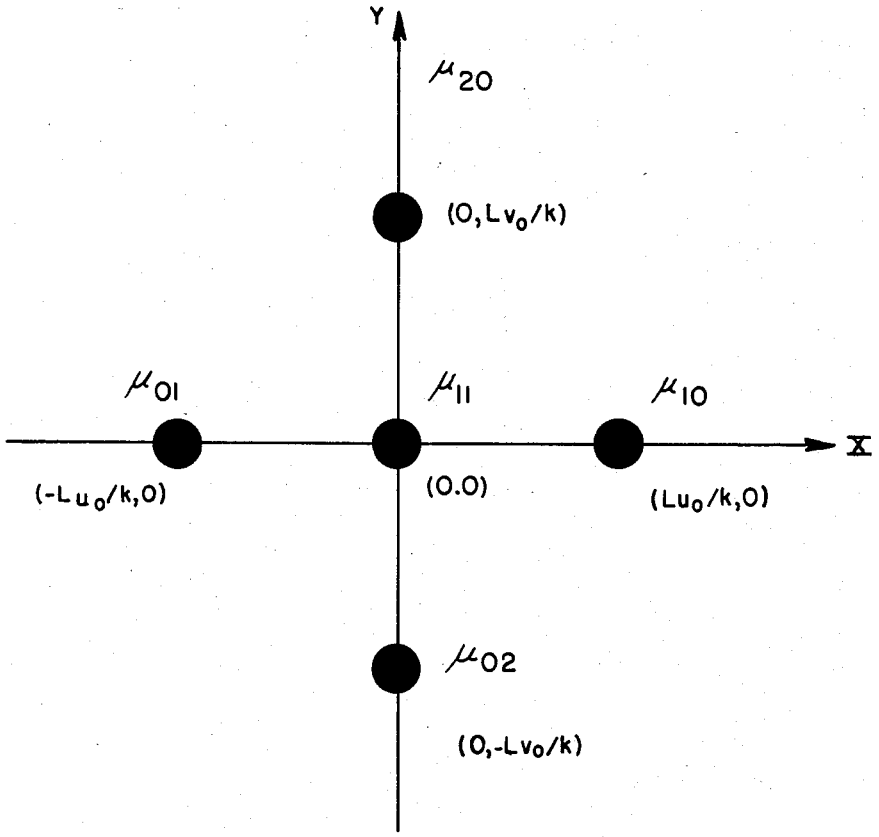
FIG. 3 shows the arrangement of the five geometric moments in the back focal plane of the lens.
Figure 4:
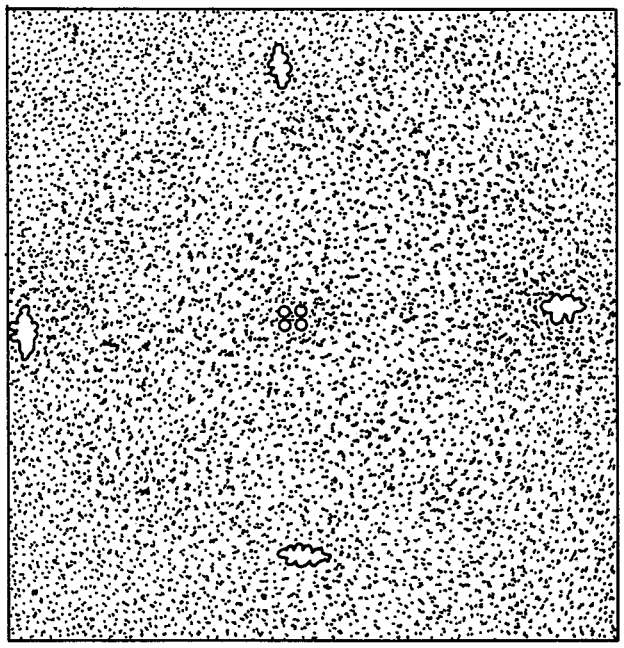
FIG. 4 is a photograph of the light distribution appearing at the array of photodetectors for a square binary object with x and y symmetry.

A computer generated holographic mask was constructed to compute the geometric moments $\mu_{10}$, $\mu_{01}$, $\mu_{11}$, $\mu_{20}$ and $\mu_{02}$ (corresponding to the generating functions x, y, xy, $x^2$ and $y^2$ respectively). The Lee-Burckhardt encoding scheme described in the above-referenced Lee article was used. In constructing the holographic mask, the generating functions were scaled such that the linear and quadratic moment values would be equal for a symmetric object ¾ the linear size of the mask (FIG. 2. Note that this shows only the positive half). This was done to alleviate the dynamic range problems in making the mask. The arrangement of the five moments in the back focal plane of the lens is shown in FIG. 3. The spacing was chosen so as to avoid crosstalk between adjacent moments. It should be noted that the arrangement is determined by the scaling factors in the spatial carrier multiplying the different generating functions and hence is completely under control of the user. FIG. 4 is a photograph of the light distribution appearing at the array 19 of photodetectors for a binary square input image. The moments are measured at the center of each of the five patterns. The $\mu_{10}$ and $\mu_{01}$ moments are seen to be zero indicating that the image had symmetry about the y and the x axis respectively.

Obviously, numerous modifications and variations of the present invention are possible in light of the above teachings. Thus, for example, the hologram could be generated in real time on a spatial light modulator, and could also be a phase hologram rather than an amplitude hologram, which would result in higher diffraction efficiency. The positive and negative components of the moments could be calculated separately and displayed in different spatial locations in the back focal plane of the lens. This would overcome the problem of determining the sign of the calculated moment. Complex moments could be similarly determined using four components: positive and negative real, and positive and negative imaginary. It is therefore to be understood that within the scope of the appended claims, the invention may be practiced otherwise than as specifically described herein.

What is claimed as new and desired to be secured by Letters Patent of the United States is:

1. An optical processor for computing a plurality of moments of the intensity function of an image in parallel comprising:

a Fourier-transform lens;

a holographic mask disposed in the front focal plane of the lens, the transmittance g(x,y) of the mask being proportional to the sum of the generating functions of each of the desired moments respectively multiplied by a corresponding spatial carrier in accordance with the following equation:

$$g(x,y) = A \sum_{m=-M}^{M} \sum_{n=-N}^{N} g_{mn}(x,y) e^{j(mu_o x + nv_o y)},$$

where x and y are the two variables defining the plane of the mask, A is a proportionality constant, $g_{mn}(x,y)$ is the generating function of the $mn^{th}$ moment, there being $2M \times 2N$ such moments, $e^{j(mu_o x + nv_o y)}$ is the separate spatial carrier for each generating function $g_{mn}(x,y)$, and $u_o$ and $v_o$ are arbitrary scaling factors; and a two-dimensional array of photodetectors disposed in the back focal plane of the lens, the individual photodetectors being spatially separated so that when the image is placed at the plane of the holographic mask, the lens forms in its back focal plane the Fourier transform of the intensity function of the image times the transmittance of the mask and each of the desired moments is found at a respective one of the photodetectors.

2. The optical processor recited in claim 1 wherein: the generating functions as bipolar.

3. The optical processor recited in claim 1 wherein: the generating functions are complex.

4. The optical processor recited in claim 1 wherein: the generating functions are moment-invariants.

5. The optical processor recited in claim 1 wherein: the generating functions are Legendre Polynomials.

6. The optical processor recited in claim 1 wherein: the generating functions are angular prolate spheroidal functions.

7. The optical processor recited in claim 1 wherein: the holographic mask is computer-generated.

8. A method of computing a plurality of moments of the intensity function of an image in parallel, comprising the steps of:

providing a holographic mask whose transmittance g(x,y) is proportional to the sum of the generating functions of each of desired moments respectively multiplied by a corresponding spatial carrier, in accordance with the following equation:

$$g(x,y) = A \sum_{m=-M}^{M} \sum_{n=-N}^{N} g_{mn}(x,y) e^{j(mu_o x + nv_o y)},$$

where x and y are the two variables defining the plane of the mask, A is a proportionality constant, $g_{mn}(x,y)$ is the generating function of the $mn^{th}$ moment, there being $2M \times 2N$ such moments, $e^{j(mu_o x + nv_o y)}$ is the separate spatial carrier for each generating function $g_{mn}(x,y)$, and $u_o$ and $v_o$ are arbitrary scaling factors;

disposing the holographic mask in the front focal plane of a Fourier transform lens;

disposing a two-dimensional array of spatially separated photodetectors in the back focal plane of the Fourier-transform lens; and placing the image at the plane of the holographic mask so that the lens forms in its back focal plane the Fourier transform of the intensity function of the image times the transmittance of the mask, and each of the desired moments is found at a respective one of the photodetectors.

9. The method recited in claim 8 wherein the image placing step includes:

laying the holographic mask on a spatial light modulator whose transmittance is proportional to the intensity function of the image of the object; and illuminating the spatial light modulator with a parallel beam of coherent light.

* * * * *